US005937658A

United States Patent [19]

Black et al.

[11] Patent Number: 5,937,658

[45] Date of Patent: Aug. 17, 1999

[54] APPARATUS AND METHOD FOR HEAD PRESSURE CONTROL VALVE DISABLING FOR AN ICEMAKER

[75] Inventors: William J. Black; Matthew W. Allison, both of Gurnee; Melvin A. Baker, Grayslake; Gary L. Van Riper, Wildwood, all of Ill.

[73] Assignee: Scotsman Group, Vernon Hills, Ill.

[21] Appl. No.: 09/030,534

[22] Filed: Feb. 24, 1998

[51] Int. Cl.[6] ..... F25C 5/10

[52] U.S. Cl. ..... 62/73; 62/196.4; 62/DIG. 17; 62/196.1

[58] Field of Search ..... 62/196.4, 196.1, 62/DIG. 17, 73

[56] References Cited

U.S. PATENT DOCUMENTS

| | | | |
|---|---|---|---|
| 2,363,273 | 11/1944 | Waterfill . | |
| 2,564,310 | 8/1951 | Nussbaum et al. . | |
| 3,145,543 | 8/1964 | Miner . | |
| 3,633,378 | 1/1972 | Toth | 62/196 |
| 4,136,528 | 1/1979 | Vogel et al. | 62/DIG. 17 |
| 4,353,221 | 10/1982 | Taylor | 62/439 |
| 4,437,317 | 3/1984 | Ibrahim | 62/81 |
| 5,555,744 | 9/1996 | Hirano | 62/352 |

*Primary Examiner*—William E. Tapolcai
*Attorney, Agent, or Firm*—Harness, Dickey & Pierce, PLC

[57] ABSTRACT

An icemaker having a means for bypassing a head pressure control valve thereof depending upon the ambient air temperature surrounding a remotely located condenser of the icemaker. The method and apparatus involve a first bypass conduit which is coupled to an outlet of the condenser upstream of the head pressure control valve and a first bypass valve disposed in the first bypass conduit. A second bypass conduit is in communication with an inlet of the condenser and also with the head pressure control valve. A second bypass valve is disposed in the second bypass conduit. A thermostat controls each of the bypass valves such that the first bypass valve is closed and the second bypass valve opened when the sensed ambient air temperature around the condenser is below a predetermined temperature, to thereby permit normal operation of the head pressure control valve. When the ambient air temperature is at or above the predetermined temperature, the first bypass valve is opened and the second bypass valve is closed, which causes condensed refrigerant to bypass the head pressure control valve completely. The above-described arrangement permits a high set point of the head pressure control to build more heat in a compressor during the freeze cycle of the icemaker when the condenser is experiencing low ambient air temperature conditions, and further allows the head pressure control valve to be bypassed entirely when the ambient air conditions are relatively high during the freeze cycle, and the head pressure control valve is therefore not needed.

15 Claims, 1 Drawing Sheet

APPARATUS AND METHOD FOR HEAD PRESSURE CONTROL VALVE DISABLING FOR AN ICEMAKER

BACKGROUND OF THE INVENTION

1. Technical Field

This invention relates to icemakers, and more particularly to a commercial icemaker having a remotely disposed condenser and a means for bypassing a head pressure control valve of the icemaker depending upon the temperature of the ambient environment surrounding the condenser.

2. Discussion

Icemakers are used in a wide variety of commercial and residential applications to produce ice in desired quantities. Large commercial icemakers often include a remotely disposed condenser. The condenser is often disposed in an outdoor environment due to the large degree of heat given off by the condenser during operation of the icemaker. Often, such condensers are located on building roof-tops. In either event, the condenser is exposed to the outdoor environment, where the air temperature can change drastically throughout the day.

Current commercial icemakers typically make use of a head pressure control valve. The purpose of this valve is to maintain a set head pressure when the ambient temperature of the air surrounding the condenser becomes too cold. The maintenance of this head pressure at a desired minimum pressure is required to maintain operation of the compressor of the icemaker within approved pressure and temperature guidelines.

During operation of such commercial icemakers, in order to achieve improved harvest performance when the condenser is experiencing low ambient temperature conditions, it is generally necessary to have a high "set point" of the head pressure control to build more heat in the compressor. However, increasing this set point pressure to accommodate low ambient conditions degrades performance of the icemaker at the icemaker rating point temperature. The icemaker rating point temperature is 90° air temperature, 70° water temperature. This is a common summertime condition. However, no control of the head pressure is required to produce adequate compressor performance at the ice maker rating points.

It would therefore be highly desirable to provide an icemaker in which the head pressure control valve thereof could be used when the ambient temperature surrounding a remotely disposed condenser of the icemaker is below a predetermined temperature, and the head pressure control valve bypassed when the ambient temperature is above a predetermined temperature. It would further be highly desirable if such a degree of control over the head pressure control valve could be incorporated with a limited number of component parts and modifications to an icemaker, and without introducing a significant degree of complexity into the icemaker.

SUMMARY OF THE INVENTION

The above and other objects are accomplished by a head pressure control valve bypass system and method of control in accordance with preferred embodiments of the present invention. In one preferred embodiment an icemaker is disclosed which incorporates a compressor, a remotely disposed condenser, a head pressure control valve coupled to an outlet of the condenser, and a first bypass conduit in communication with the outlet of the condenser upstream of the head pressure control valve. The first bypass conduit has a first valve disposed therein which is controlled by a thermostat. When the ambient temperature surrounding the condenser is below a predetermined temperature, the thermostat senses this and maintains the first valve closed to prohibit the flow of refrigerant through the first bypass conduit. This prevents the head pressure control valve from being bypassed and allows it to operate in its normal manner. When the ambient temperature is above the predetermined temperature, the thermostat senses this and opens the first valve in the first bypass conduit. Refrigerant is then able to flow through the first bypass conduit bypassing the head pressure control valve.

In the preferred embodiment described above, a second bypass conduit is also preferably included. The second bypass conduit is in communication with the discharge port of the compressor upstream of an inlet of the condenser, and also with an input of the head pressure control valve. A second valve is disposed in the second bypass conduit and is also controlled by the thermostat. When opened, the second valve permits a quantity of refrigerant to be diverted from the inlet of the condenser, thus bypassing the condenser. When closed, the second valve prevents the flow of refrigerant through the second bypass conduit, thus forcing the entire quantity of refrigerant to be directed into the inlet of the condenser.

When the ambient temperature is sensed by the thermostat to be below the predetermined temperature, the first valve in the first bypass conduit is closed and the second valve in the second bypass conduit is opened. This allows the head pressure control valve to operate in its normal manner. When the ambient temperature is sensed as being at or above the predetermined temperature, the second bypass valve is closed and the first valve in the first bypass conduit is opened, thus bypassing the head pressure control valve entirely.

The above described arrangement overcomes the problems with using a high set point of the head pressure control to build more heat in the compressor to properly carry out a harvest cycle of the icemaker in cold ambient conditions. By the present invention, an effective "high" set point of the head pressure control valve can be achieved when the condenser is subject to low ambient temperatures, to thereby insure adequate harvest performance, and the high set point removed when the ambient temperature is higher (i.e., warmer). The preferred method of the present invention involves using the above-described thermostat to alternately open and close the two valves described above, depending on the ambient temperature, to controllably bypass the head pressure control valve.

The method and apparatus of the present invention permits a high set point of the head pressure control to be implemented when the ambient air temperature surrounding the condenser is below a predetermined temperature, while enabling the head pressure control valve to be bypassed entirely when the ambient air temperature is sensed as being above the predetermined temperature. The controlled bypassing of the head pressure control valve is therefore accomplished with a minimum number of component parts and without significant added complexity to the icemaker.

BRIEF DESCRIPTION OF THE DRAWING

The various advantages of the present invention will become apparent to one skilled in the art by reading the following specification and subjoined claims and by referencing the following drawing in which:

DETAILED DESCRIPTION OF THE PREFERRED EMBODIMENTS

Figure 1:
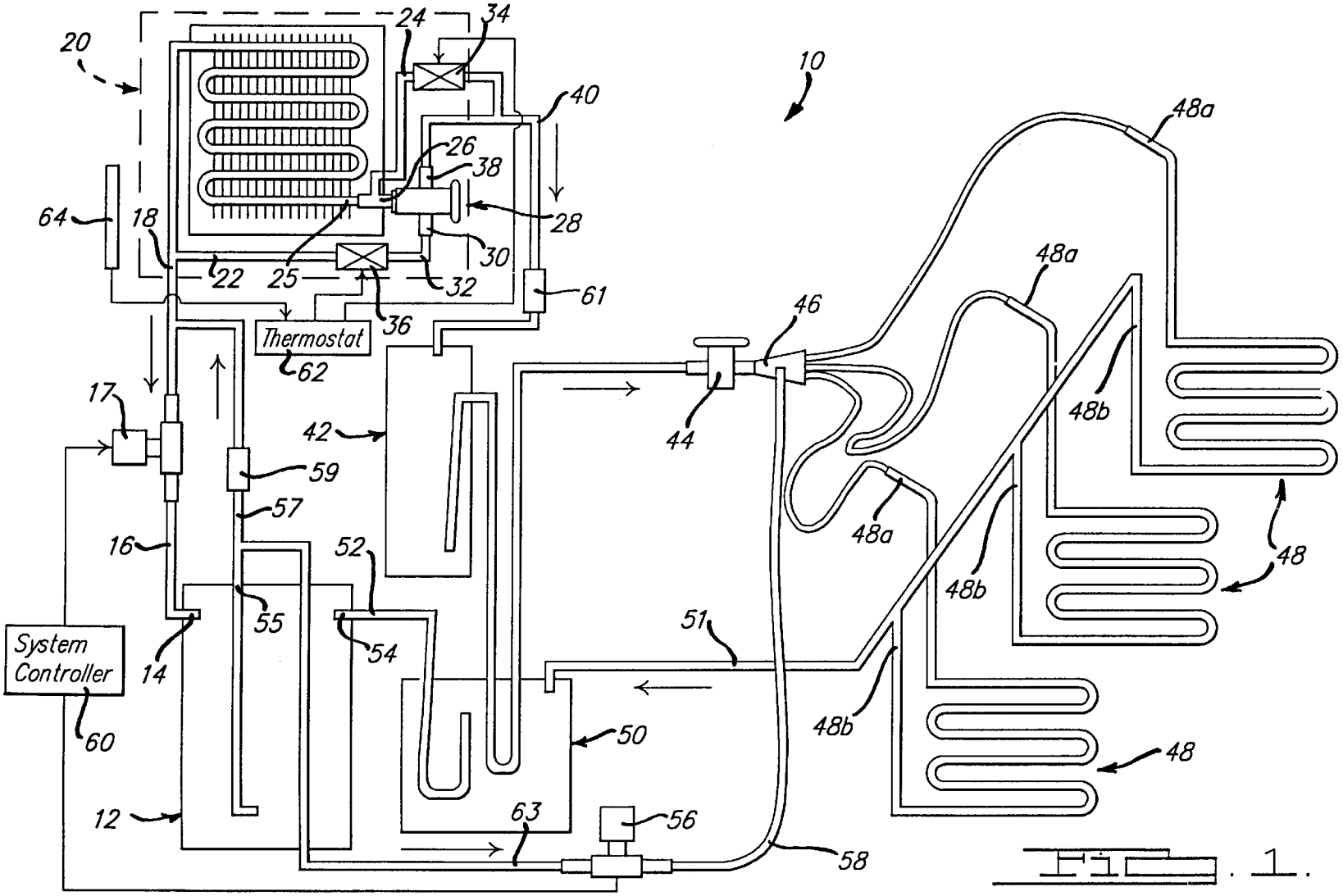
FIG. 1 is a schematic diagram of an icemaker incorporating the head pressure control valve bypass apparatus and method of the present invention.

Referring to FIG. 1, there is shown an icemaker 10 in accordance with the present invention. The icemaker generally includes a compressor 12 having an inlet or suction port 14 into which hot vaporous refrigerant may be injected, a first conduit 16, a hot gas bypass valve 17 disposed in series with the conduit 16, which is in turn in communication with an inlet 18 of a condenser 20 and teed into a bypass conduit 22. One end of the bypass conduit 22 is disposed upstream of the condenser inlet 18. The condenser 20 is disposed remotely of the icemaker, such as outdoors adjacent a building or on a roof-top of a building. As such, the condenser 20 experiences the temperature of the outdoor ambient environment. In many areas of the country, the outdoor ambient temperature, as will be appreciated, varies significantly throughout various months of the year. The ambient temperature, in most portions of the country, also varies significantly throughout the day. Early morning hours are usually significantly cooler than afternoon hours. Thus, the condenser 20 must operate in a wide range of ambient outdoor temperatures.

With further reference to FIG. 1, the icemaker 10 includes another bypass conduit 24 which is teed into an outlet 25 of the condenser 20 and a first input or inlet 26 of a conventional head pressure control valve 28. A second input or inlet 30 of the head pressure control valve 28 is in communication with the other end 32 of the bypass conduit 22.

A first bypass valve 34 is disposed in the bypass conduit 24, and a second bypass valve 36 is disposed in the bypass conduit 22. An output or outlet 38 of the head pressure control valve 28 is coupled to a conduit 40 which extends into a conventional receiver 42. The bypass conduit 24 is also teed into conduit 40.

Liquid refrigerant is collected in the receiver 42 and withdrawn through a thermostatic expansion valve 44 and a refrigerant distributor 46 before entering an inlet 48*a* of each of a plurality of evaporators 48. The refrigerant circulated through the evaporators is discharged at an outlet 48*b* of each evaporator and directed into an accumulator 50 through conduit 51. A conduit 52 coupled to a suction or inlet port 54 of the compressor 12 draws the vaporous refrigerant out of the accumulator, compresses it and discharges the compressed, hot vaporous refrigerant out of the discharge port 55 and back into a discharge conduit 57. The discharge conduit 57 includes a one-way check valve 59 to prevent vaporous refrigerant from flowing back into the conduit 63 during the harvest cycle.

It will also be appreciated that the icemaker 10 incorporates a "freeze" cycle of operation in which water is circulated over the evaporators 48 to form ice cubes thereon, and a "harvest" cycle of operation in which hot gas is directed from the discharge port 55 of the compressor 12 into the evaporators 48 to warm the evaporators to help release the ice cubes which have formed on the evaporators. To this end a hot gas valve 56 is included and teed into the discharge conduit 57 through conduit 63. The opposite side of the hot gas valve 56 is coupled to a conduit 58 which is in turn coupled to the refrigerant distributor 46. The hot gas valve 56 is further controlled by a system controller 60, and is opened by a signal from the system controller 60 when the harvest cycle is entered to allow the hot vaporous refrigerant to flow through the hot gas valve 56 and into the evaporators 48. The system controller 60 also operates to send a signal to the hot gas bypass valve 17 to open the valve 17 to permit hot vaporous refrigerant to migrate back into the inlet port 14 of the compressor 12 during the harvest cycle. Check valve 59 and a second check valve 61 disposed in conduit 40 prevent refrigerant from migrating back into conduit 63. In this manner it can be insured that a sufficient quantity of refrigerant is available to carry out the harvest cycle.

With further reference to FIG. 1, a thermostat 62 is provided which is mechanically coupled to a temperature sensing device 64 disposed in the near vicinity of the condenser 20 and to the bypass valves 34 and 36.

In operation, when the outdoor ambient air temperature around the condenser 20 is sensed by the temperature sensing device 64 as being below a predetermined temperature, the thermostat 62 sends an electrical signal to the bypass valve 34 which causes valve 34 to be closed. Substantially simultaneously, an electrical signal is also sent to the second bypass valve 36 which opens this valve. In this manner the head pressure control valve 28 can operate in a normal manner to implement a high set point of the head pressure control to build more heat in the compressor 12. The predetermined temperature is a temperature preferably within the range of about 60° F.–70° F., and most preferably about 65° F.

When the ambient air temperature surrounding the condenser 20 is at or above the predetermined temperature, the thermostat 62 opens the bypass valve 34 and closes the bypass valve 36. This allows condensed refrigerant to flow through the bypass conduit 24 and therefore bypass entirely the head pressure control valve 28. Since the second bypass valve 36 is closed, no vaporous refrigerant can flow through the conduit 22. Thus, when the harvest cycle is to be performed when the condenser 20 is experiencing low ambient air temperatures, a high set point can be enabled to help the compressor build more heat. If the condenser 20 is already experiencing relatively high ambient air temperatures, and the head pressure control valve 28 is not needed, the valve 28 can be quickly and easily bypassed. Valves 34 and 36, being each electrically actuated solenoid valves, operate quickly, easily and efficiently to alternately block and open the bypass conduits 22 and 24 as needed depending upon the sensed ambient air temperature around the condenser 20.

The method of the present invention involves controlling the valves 34 and 36 as described above. The temperature sensing device 64 is used to sense the ambient air temperature around the condenser 20 and send a signal to the thermostat 62 indicative of the sensed temperature. If the sensed temperature is below the predetermined temperature, the bypass valve 34 is closed and bypass valve 36 is opened to allow normal operation of the head pressure control valve 28. If the sensed temperature is above the predetermined temperature, then the operation is reversed; that is, the second bypass valve 36 is closed and the first bypass valve 34 is opened, thus bypassing the valve 28.

Those skilled in the art can now appreciate from the foregoing description that the broad teachings of the present invention can be implemented in a variety of forms. Therefore, while this invention has been described in connection with particular examples thereof, the true scope of the invention should not be so limited since other modifications will become apparent to the skilled practitioner upon a study of the drawings, specification and following claims.

What is claimed is:

1. An icemaker, comprising:

a compressor;

a condenser having an inlet coupled to a first conduit, said first conduit being coupled to a discharge port of said compressor;

a head pressure control valve having a first input, a second input and an output, said first input being in communication with an outlet of said condenser;

a first bypass conduit in communication with said outlet of said condenser upstream of said first input of said head pressure control valve;

a first bypass valve disposed in said first bypass conduit, said first bypass valve permitting flow of refrigerant through said first bypass conduit when opened to thereby bypass said head pressure control valve;

a second bypass conduit in communication with said inlet of said condenser and with said second input of said head pressure control valve;

a second bypass valve disposed in said second bypass conduit for permitting flow of refrigerant therethrough, and therefore through said head pressure control valve, when said second bypass valve is opened and a predetermined upper pressure limit is reached in said second bypass conduit; and an ambient temperature sensing device for sensing an ambient temperature adjacent said condenser and closing said first bypass valve and opening said second bypass valve when said ambient temperature is below a predetermined temperature, and for opening said first bypass valve and closing said second bypass valve when said ambient temperature is above said predetermined temperature to thereby bypass said head pressure control valve.

2. The icemaker of claim 1, wherein said ambient temperature sensing device comprises a thermostat.

3. The icemaker of claim 1, wherein said predetermined temperature comprises a temperature within a range of about 60° F.–70° F.

4. The icemaker of claim 1, wherein each of said first and second bypass valves comprise an electrically actuated solenoid valve.

5. An icemaker comprising:

a compressor;

a condenser having an inlet coupled to a first conduit, said first conduit being coupled to a discharge port of said compressor;

a head pressure control valve having at least a first input and an output, said first input being in communication with an outlet of said condenser;

a bypass conduit communicating with said outlet of said condenser upstream of said first input of said head pressure control valve;

a valve disposed in said bypass conduit for controlling the flow of refrigerant through said bypass conduit; and a temperature sensing device for sensing an ambient temperature of an environment in which said condenser is disposed and for opening said valve when said ambient environment exceeds a predetermined temperature, thereby bypassing said head pressure control valve, and for maintaining said valve closed to prevent the flow of said refrigerant through said bypass conduit when said ambient temperature is below said predetermined temperature.

6. The icemaker of claim 5, further comprising:

a second bypass conduit in communication with said inlet of said condenser and second input of said head pressure control valve; and a second valve disposed in said second bypass conduit, said second valve being closed when said valve in said bypass conduit is opened and said second valve being opened when said valve in said bypass conduit is closed.

7. The icemaker of claim 6, wherein said second valve is controlled by said temperature sensing device.

8. The icemaker of claim 7, wherein said temperature sensing device comprises a thermostat electrically coupled to said valve in said bypass conduit and to said second valve.

9. An icemaker, comprising:

a compressor;

a condenser located remotely from said compressor and exposed to an ambient environment different from that of said compressor, said condenser having an inlet in communication with a discharge port of said compressor and an outlet;

a head pressure control valve in communication with said outlet of said condenser;

a bypass conduit in communication with said outlet of said condenser;

a bypass valve disposed in said bypass conduit; and a thermostat for controlling said bypass valve such that said bypass valve is opened to permit flow of refrigerant through said bypass conduit when said ambient temperature around said condenser exceeds a predetermined temperature, and for closing said bypass valve when said ambient temperature around said condenser is below said predetermined temperature; and wherein when said bypass valve is opened refrigerant flowing from said condenser flows through said bypass conduit, thereby bypassing said head pressure control valve, and when said bypass valve is closed said refrigerant is forced to flow through said head pressure control valve.

10. The icemaker of claim 9, further comprising:

a second bypass conduit in communication with said inlet of said condenser and with said head pressure control valve;

a second valve disposed in said second bypass conduit, said second valve being controlled by said thermostat;

said second valve being closed by said thermostat when said valve in said bypass conduit is opened; and said second valve being opened when said valve in said bypass conduit is closed, thereby permitting said head pressure control valve to divert a quantity of refrigerant from said inlet of said condenser around said condenser.

11. A method for controlling the flow of refrigerant in an icemaker having a condenser located remotely from a compressor of the icemaker during a harvest cycle of the icemaker, said method comprising the steps of:

sensing a temperature of said ambient environment surrounding said condenser;

causing refrigerant to flow from a discharge port of said compressor through said condenser and subsequently through a head pressure control valve when said temperature of said ambient environment is sensed to be below a predetermined temperature; and causing refrigerant flowing out of said condenser to bypass said head pressure control valve when said temperature of said ambient environment is sensed as being above said predetermined temperature.

12. The method of claim 11, further comprising the step of causing a portion of said refrigerant flowing from said discharge port of said compressor to be diverted from an inlet of said condenser by said head pressure control valve when said pressure in said condenser is sensed as being less than said predetermined pressure.

13. A method for controllably bypassing a head pressure control valve of an icemaker during a harvest cycle of the icemaker depending upon the ambient temperature surrounding a remotely disposed condenser of said icemaker, said method comprising the steps of:

sensing said ambient temperature surrounding said remotely disposed condenser;

when said ambient temperature is sensed as being at or above a predetermined temperature, causing refrigerant flowing through said condenser to bypass said head pressure control valve and to flow through at least one evaporator of the icemaker;

when said ambient temperature is sensed as being below said predetermined temperature, causing the entire quantity of refrigerant flowing through said condenser to flow through said head pressure control valve; and when said pressure is sensed as being below said predetermined pressure, using said head pressure control valve to permit a quantity of refrigerant flowing into an inlet of said condenser to be diverted from said inlet directed through said head pressure control valve, and supplied to said evaporator.

14. The method of claim 13, wherein the step of causing said refrigerant flowing through said condenser to bypass said head pressure control valve comprises the steps of:

disposing a bypass conduit in communication with an outlet of said condenser upstream of an inlet of said head pressure control valve;

disposing a valve in said bypass conduit; and opening said valve when said ambient temperature is sensed as being at or above said predetermined temperature.

15. The method of claim 14, wherein the step of causing said quantity of refrigerant to be bypassed from said inlet of said condenser to said evaporator comprises the steps of:

disposing a second bypass conduit upstream of said inlet of said condenser and in communication with said head pressure control valve;

disposing a second valve in said second bypass conduit; and opening said second valve when said ambient temperature is sensed as being below said predetermined temperature; and causing said valve in said bypass conduit to be closed when said ambient temperature is sensed as being below said predetermined temperature.

* * * * *